US011639648B2

(12) United States Patent
Hall et al.

(10) Patent No.: US 11,639,648 B2
(45) **Date of Patent: *May 2, 2023**

(54) DOWNHOLE TURBINE ASSEMBLY

(71) Applicant: Schlumberger Technology Corporation, Sugar Land, TX (US)

(72) Inventors: David R. Hall, Provo, UT (US); Jonathan D. Marshall, Springville, UT (US); Jordan D. Englund, Provo, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 40 days.

This patent is subject to a terminal disclaimer.

(21) Appl. No.: 17/152,086

(22) Filed: Jan. 19, 2021

(65) Prior Publication Data

US 2021/0140277 A1 May 13, 2021

Related U.S. Application Data

(63) Continuation of application No. 16/163,627, filed on Oct. 18, 2018, now Pat. No. 10,907,448, which is a continuation of application No. 15/152,189, filed on May 11, 2016, now Pat. No. 10,113,399.

(60) Provisional application No. 62/164,933, filed on May 21, 2015.

(51) Int. Cl.
*E21B 41/00* (2006.01)

(52) U.S. Cl.
CPC ..... *E21B 41/0085* (2013.01)

(58) Field of Classification Search
CPC ..... E21B 41/0085; E21B 21/10; E21B 21/12
See application file for complete search history.

(56) References Cited

U.S. PATENT DOCUMENTS

| | | | | |
|---|---|---|---|---|
| 2,266,355 | A | 12/1941 | Chun | |
| 3,534,822 | A * | 10/1970 | Campbell | E21B 21/14 175/69 |
| 4,132,269 | A | 1/1979 | Chasteen | |
| 4,155,022 | A | 5/1979 | Crockett | |
| 4,491,738 | A | 1/1985 | Kamp | |
| 4,532,614 | A | 7/1985 | Peppers | |
| 4,628,995 | A | 12/1986 | Young et al. | |
| 4,671,735 | A | 6/1987 | Rossmann et al. | |
| 5,246,035 | A | 9/1993 | Skyllingstad et al. | |
| 5,248,896 | A | 9/1993 | Forrest | |

(Continued)

FOREIGN PATENT DOCUMENTS

WO 2018093355 A1 5/2018

OTHER PUBLICATIONS

International Search Report and Written Opinion issued in International Patent Application No. PCT/US2016/062116, dated Sep. 26, 2017, 25 pages.

(Continued)

*Primary Examiner* — Brad Harcourt

(57) ABSTRACT

A downhole turbine assembly may comprise a tangential turbine disposed within a section of drill pipe. A portion of a fluid flowing through the drill pipe may be diverted to the tangential turbine generally perpendicular to the turbine's axis of rotation. After rotating the tangential turbine, the diverted portion may be discharged to an exterior of the drill pipe.

20 Claims, 4 Drawing Sheets

(56) References Cited

U.S. PATENT DOCUMENTS

| | | | | |
|---|---|---|---|---|
| 5,265,682 | A | 11/1993 | Russell et al. | |
| 5,285,204 | A | 2/1994 | Sas-Jaworsky | |
| 5,517,464 | A | 5/1996 | Lerner et al. | |
| 5,803,185 | A | 9/1998 | Barr et al. | |
| 5,839,508 | A | 11/1998 | Tubel et al. | |
| 6,089,332 | A | 7/2000 | Barr et al. | |
| 6,386,302 | B1 | 5/2002 | Beaton | |
| 6,554,074 | B2 | 4/2003 | Longbottom | |
| 6,607,030 | B2 | 8/2003 | Bauer et al. | |
| 6,672,409 | B1 | 1/2004 | Dock et al. | |
| 6,717,283 | B2 | 4/2004 | Skinner et al. | |
| 6,848,503 | B2 | 2/2005 | Schultz et al. | |
| 6,851,481 | B2 | 2/2005 | Vinegar et al. | |
| 7,002,261 | B2 | 2/2006 | Cousins | |
| 7,133,325 | B2 | 11/2006 | Kotsonis et al. | |
| 7,137,463 | B2 | 11/2006 | Beaton | |
| 7,190,084 | B2 | 3/2007 | Hall et al. | |
| 7,293,617 | B2 | 11/2007 | Beaton | |
| 7,348,893 | B2 | 3/2008 | Huang et al. | |
| 7,434,634 | B1 | 10/2008 | Hall et al. | |
| 7,451,835 | B1 | 11/2008 | Hall et al. | |
| 7,484,576 | B2 | 2/2009 | Hall et al. | |
| 7,537,051 | B1 | 5/2009 | Hall et al. | |
| 7,650,952 | B2 | 1/2010 | Evans et al. | |
| 7,814,993 | B2 | 10/2010 | White | |
| 8,033,328 | B2 | 10/2011 | Hall et al. | |
| 8,092,147 | B2 | 1/2012 | Draeger et al. | |
| 8,297,375 | B2 | 10/2012 | Hall et al. | |
| 8,297,378 | B2 | 10/2012 | Hall et al. | |
| 8,366,400 | B2 | 2/2013 | Ochiai et al. | |
| 8,596,368 | B2 | 12/2013 | Frosell | |
| 8,656,589 | B2 | 2/2014 | Kurt-Elli | |
| 8,792,304 | B2 | 7/2014 | Sugiura | |
| 8,957,538 | B2 | 2/2015 | Inman et al. | |
| 9,013,957 | B2 | 4/2015 | Vecseri et al. | |
| 9,035,788 | B2 | 5/2015 | Downton et al. | |
| 9,038,735 | B2 | 5/2015 | Segura et al. | |
| 9,046,080 | B2 | 6/2015 | Sliwa | |
| 9,309,748 | B2 | 4/2016 | Gadot et al. | |
| 9,312,557 | B2 | 4/2016 | Zhang et al. | |
| 9,356,497 | B2 | 5/2016 | Chambers | |
| 9,466,695 | B2 | 10/2016 | Taraud et al. | |
| 9,534,577 | B2 | 1/2017 | Inman et al. | |
| 9,546,539 | B2 | 1/2017 | Hudson et al. | |
| 9,598,937 | B2 | 3/2017 | Chen et al. | |
| 10,113,399 | B2 | 10/2018 | Hall et al. | |
| 10,233,694 | B2 | 3/2019 | Li et al. | |
| 10,907,448 | B2 * | 2/2021 | Hall | E21B 41/0085 |
| 2002/0125047 | A1 | 9/2002 | Beaton | |
| 2002/0162654 | A1 | 11/2002 | Bauer et al. | |
| 2003/0116969 | A1 | 6/2003 | Skinner et al. | |
| 2004/0108116 | A1 | 6/2004 | McLoughlin et al. | |
| 2004/0206552 | A1 | 10/2004 | Beaton | |
| 2005/0012340 | A1 | 1/2005 | Cousins | |
| 2005/0139393 | A1 | 6/2005 | Maurer et al. | |
| 2006/0016606 | A1 | 1/2006 | Tubel et al. | |
| 2006/0100968 | A1 | 5/2006 | Hall et al. | |
| 2006/0175838 | A1 | 8/2006 | Tips | |
| 2007/0029115 | A1 | 2/2007 | Beaton | |
| 2007/0175032 | A1 | 8/2007 | Kurt-Elli | |
| 2007/0194948 | A1 | 8/2007 | Hall et al. | |
| 2007/0272410 | A1 | 11/2007 | Hromas et al. | |
| 2008/0047753 | A1 | 2/2008 | Hall et al. | |
| 2008/0047754 | A1 | 2/2008 | Evans et al. | |
| 2008/0226460 | A1 | 9/2008 | Ochiai et al. | |
| 2008/0284174 | A1 | 11/2008 | Nagler | |
| 2008/0298962 | A1 | 12/2008 | Sliwa | |
| 2010/0065334 | A1 | 3/2010 | Hall et al. | |
| 2011/0273147 | A1 | 11/2011 | Hall et al. | |
| 2011/0280105 | A1 | 11/2011 | Hall et al. | |
| 2012/0139250 | A1 | 6/2012 | Inman et al. | |
| 2014/0014413 | A1 | 1/2014 | Niina et al. | |
| 2014/0124209 | A1 | 5/2014 | Møgedal | |
| 2014/0174733 | A1 | 6/2014 | Gadot et al. | |
| 2015/0034294 | A1 * | 2/2015 | Miles | H02K 5/132 166/66.5 |
| 2015/0090444 | A1 * | 4/2015 | Partouche | E21B 47/13 166/254.2 |
| 2015/0107244 | A1 | 4/2015 | Lakic | |
| 2015/0194860 | A1 | 7/2015 | Caliz et al. | |
| 2016/0017693 | A1 | 1/2016 | Winslow et al. | |
| 2016/0265315 | A1 | 9/2016 | Frosell et al. | |
| 2016/0341012 | A1 | 11/2016 | Riley et al. | |
| 2016/0341013 | A1 | 11/2016 | Hall et al. | |
| 2017/0241242 | A1 | 8/2017 | Marshall et al. | |
| 2018/0135434 | A1 | 5/2018 | Hall et al. | |
| 2019/0048691 | A1 | 2/2019 | Hall et al. | |

OTHER PUBLICATIONS

Office Action Issued in U.S. Appl. No. 15/352,620 dated Dec. 27, 2017, 10 pages.
Office Action Issued in U.S. Appl. No. 15/352,620 dated May 14, 2018, 10 pages.
Office Action issued in U.S. Appl. No. 15/352,620 dated Sep. 24, 2018, 10 pages.
Office Action issued in U.S. Appl. No. 15/590,882 dated Dec. 10, 2018, 8 pages.
Office Action issued in U.S. Appl. No. 15/590,882 dated Apr. 24, 2019, 6 pages.
Office Action in U.S. Appl. No. 17/180,974, dated Mar. 31, 2022, 15 pages.
Second Office Action in Chinese Patent Application No. 2016009154.4, dated Dec. 20, 2021, 32 pages.
Third Office Action in Chinese Patent Application No. 2016009154.4, dated Mar. 16, 2022, 30 pages.
First Chinese Office Action and Search Report in Chinese Patent Application No. 2016009154.4, dated Apr. 2, 2021, 29 pages.

* cited by examiner

DOWNHOLE TURBINE ASSEMBLY

CROSS REFERENCE TO RELATED APPLICATIONS

This patent application is a continuation of U.S. patent application Ser. No. 16/163,627, filed Oct. 18, 2018 and entitled "Downhole Turbine Assembly" which is a continuation of U.S. patent application Ser. No. 15/152,189, filed May 11, 2016 and entitled "Downhole Turbine Assembly," which claims priority to U.S. Provisional Pat. App. No. 62/164,933 filed on May 21, 2015 and entitled "Downhole Power Generator," each of which is incorporated herein by reference for all that they contain.

BACKGROUND

In endeavors such as the exploration or extraction of subterranean resources such as oil, gas, and geothermal energy, it is common to form boreholes in the earth. To form such a borehole 111, a specialized drill bit 112 may be suspended from a derrick 113 by a drill string 114 as shown in FIG. 1. This drill string 114 may be formed from a plurality of drill pipe sections 115 fastened together end-to-end. As the drill bit 112 is rotated, either at the derrick 113 or by a downhole motor, it may engage and degrade a subterranean formation 116 to form a borehole 111 therethrough. Drilling fluid may be passed along the drill string 114, through each of the drill pipe sections 115, and expelled at the drill bit 112 to cool and lubricate the drill bit 112 as well as carry loose debris to a surface of the borehole 111 through an annulus surrounding the drill string 114.

Various electronic devices, such as sensors, receivers, communicators or other tools, may be disposed along the drill string or at the drill bit. To power such devices, it is known to generate electrical power downhole by converting kinetic energy from the flowing drilling fluid by means of a generator. One example of such a downhole generator is described in U.S. Pat. No. 8,957,538 to Inman et al. as comprising a turbine located on the axis of a drill pipe, which has outwardly projecting rotor vanes, mounted on a mud-lubricated bearing system to extract energy from the flow. The turbine transmits its mechanical energy via a central shaft to an on-axis electrical generator which houses magnets and coils.

One limitation of this on-axis arrangement, as identified by Inman, is the difficultly of passing devices through the drill string past the generator. Passing devices through the drill string may be desirable when performing surveys, maintenance and/or fishing operations. To address this problem, Inman provides a detachable section that can be retrieved from the downhole drilling environment to leave an axially-located through bore without removing the entire drill string.

The turbine described by Inman is known as an axial turbine because the fluid turning the turbine flows parallel to the turbine's axis of rotation. An example of an axial turbine 220 is shown in FIG. 2 connected to a rotor 221 portion of a generator 222. Both axial turbine 220 and rotor 221 may be disposed within and coaxial with a section of a drill pipe 215. Drilling fluid 223 flowing through the drill pipe 215 may engage a plurality of vanes 224 disposed about the axial turbine 220 causing both axial turbine 220 and rotor 221 to rotate on a fluid-lubricated bearing system 225. In the embodiment shown, the rotor 221 comprises a plurality of magnets 226 disposed about the rotor 221. Movement of the magnets 226 may induce electrical current in coils of wire 227 wound around poles 228 of a stator 229.

It may be typical in downhole applications employing an axial turbine to pass around 800 gallons/minute (3.028 $m^3$/min) of drilling fluid past such a turbine. As the drilling fluid rotates the axial turbine, it may experience a pressure drop of approximately 5 pounds/square inch (34.47 kPa). Requiring such a large amount of drilling fluid to rotate a downhole turbine may limit a drilling operator's ability to control other drilling operations that may also require a certain amount of drilling fluid.

A need therefore exists for a downhole turbine that requires less fluid flow to operate. An additional need exists for a downhole turbine that does not require retrieving a detachable section in order to pass devices through a drill string.

SUMMARY

A downhole turbine assembly may comprise a tangential turbine disposed within a section of drill pipe. A portion of a fluid flowing through the drill pipe may be diverted to the tangential turbine generally perpendicular to the turbine's axis of rotation. After rotating the tangential turbine, the diverted portion may be discharged to an exterior of the drill pipe.

As the pressure difference between fluid inside the drill pipe and fluid outside the drill pipe may be substantial, it may be possible to produce a substantially similar amount of energy from a tangential turbine, as compared to an axial turbine, while utilizing substantially less drilling fluid. For example, while it may be typical in downhole applications to pass around 800 gallons/minute (3.028 $m^3$/min) of drilling fluid past an axial turbine of the prior art, as discussed previously, which then may experience a pressure drop of around 5 pounds/square inch (34.47 kPa), diverting around 1-10 gallons/minute (0.003785-0.03785 $m^3$/min) of drilling fluid past a tangential turbine and then discharging it to an annulus surrounding a drill pipe may allow that fluid to experience a pressure drop of around 500-1000 pounds/square inch (3,447-6,895 kPa) capable of producing substantially similar energy.

DETAILED DESCRIPTION

Figure 1:
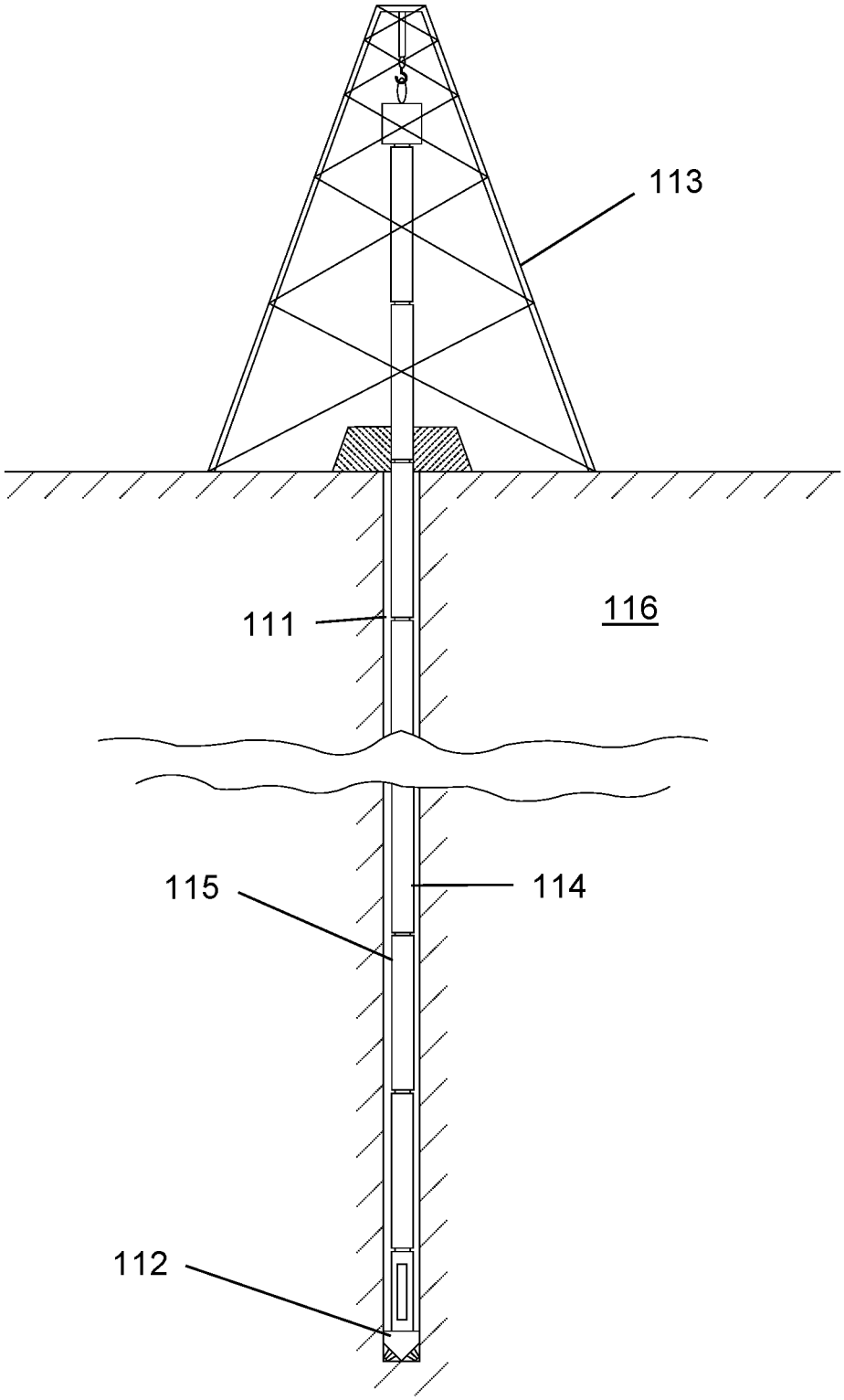
FIG. 1 is an orthogonal view of an embodiment of a drilling operation comprising a drill bit secured to an end of a drill string suspended from a derrick.
Figure 2:
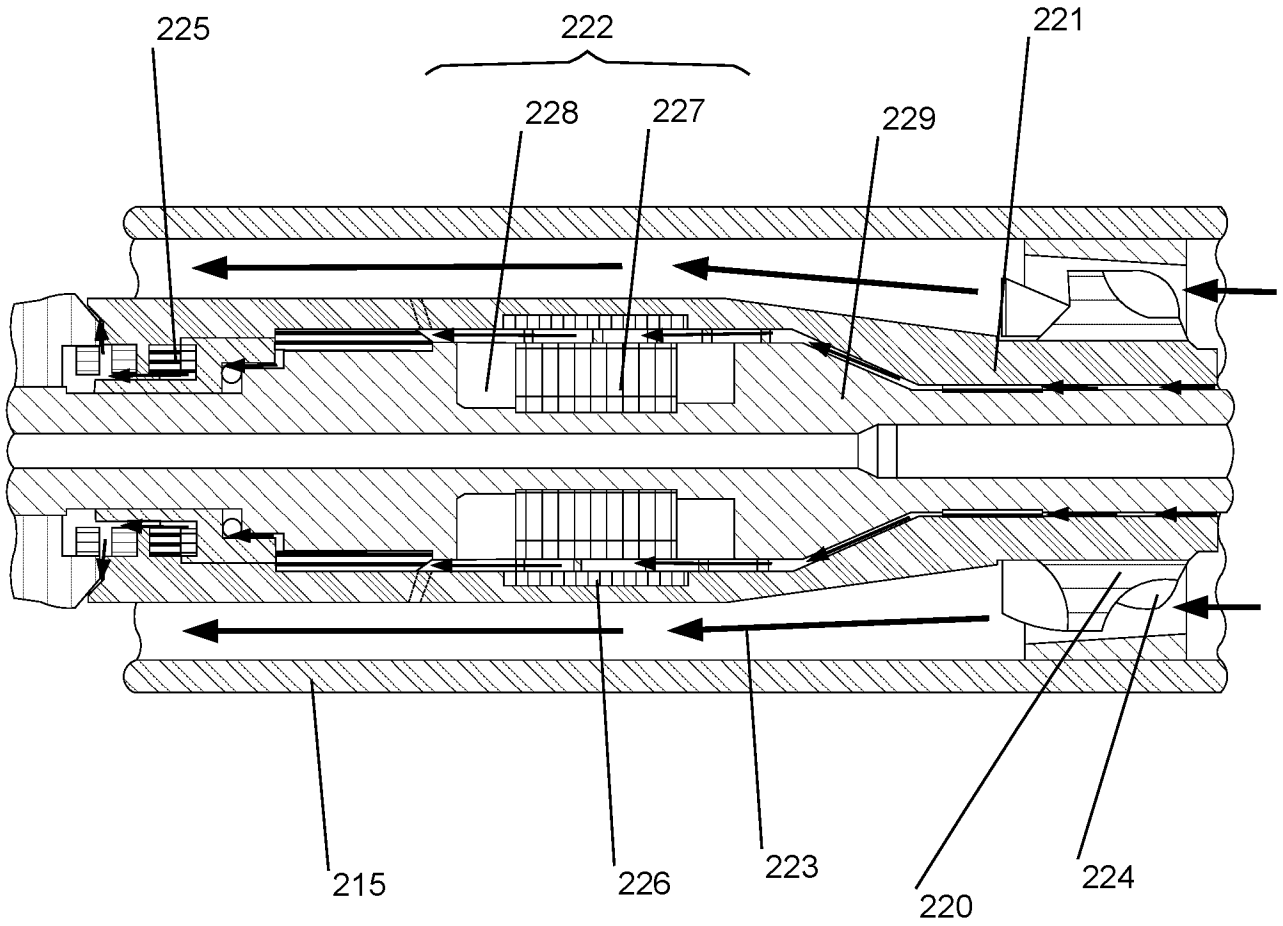
PRIOR ART FIG. 2
FIG. 2 is a schematic representation of an embodiment of an axial turbine of the prior art disposed within a portion of a drill pipe with fluid flowing therethrough.
Figure 3:
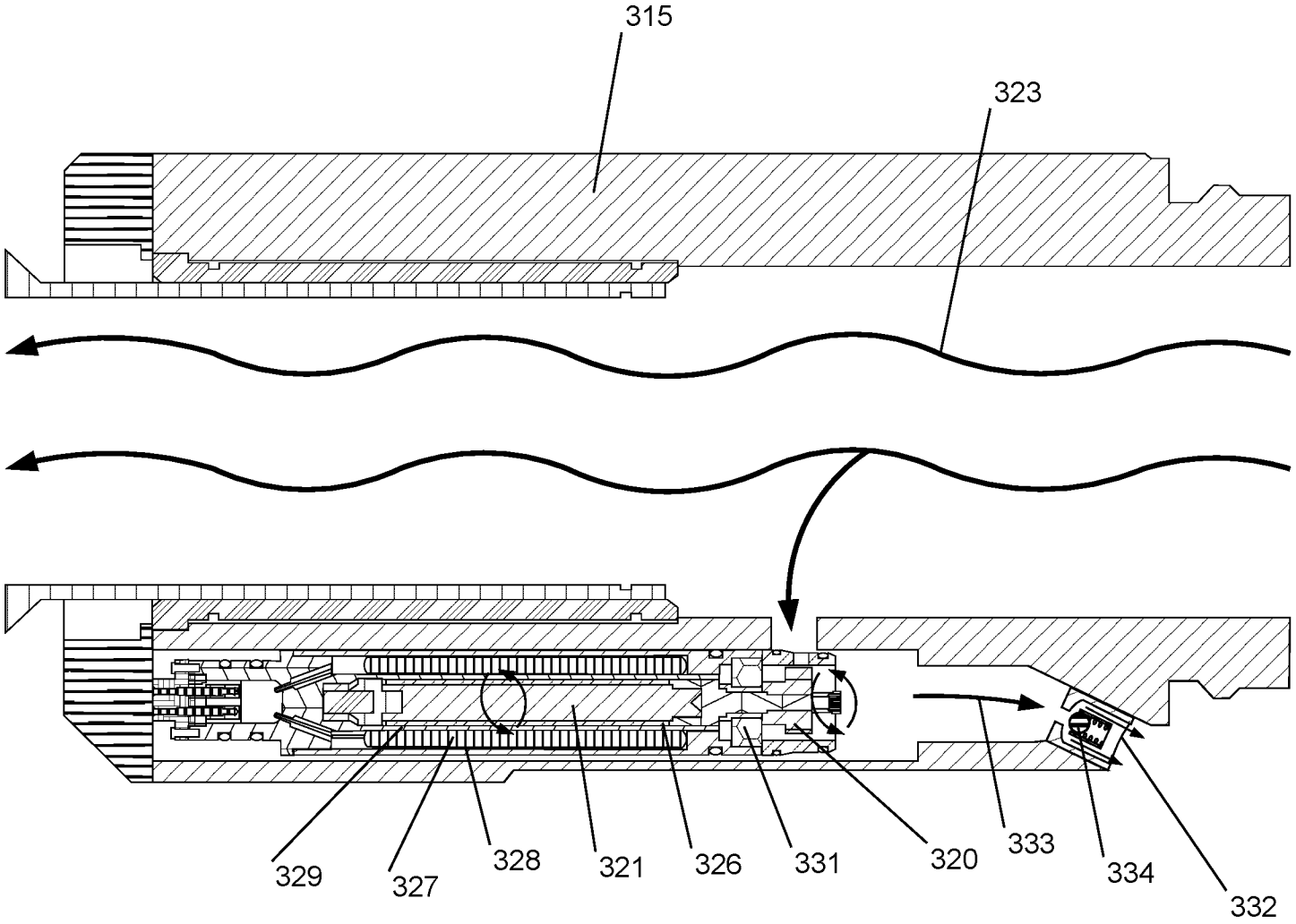
FIG. 3 is a schematic representation of an embodiment of a tangential turbine disposed within a portion of a drill pipe with fluid flowing therethrough.

FIG. 3 shows one embodiment of a tangential turbine 320 disposed within a section of a drill pipe 315. A portion of drilling fluid 333 flowing through the drill pipe 315 may be diverted away from a primary drilling fluid 323 flow and discharged to an annulus surrounding the drill pipe 315. The diverted portion of drilling fluid 333 may be directed toward the tangential turbine 320 within a plane generally perpendicular to an axis of rotation of the tangential turbine 320. The diverted portion of drilling fluid 333 may cause the tangential turbine 320 and a rotor 321 connected thereto to rotate. The rotor 321 may comprise a plurality of magnets 326 disposed about the rotor 321. Movement of the magnets 326 may induce electrical current in coils of wire 327 wound around poles 328 of a stator 329 in a generator. Those of skill in the art will recognize that, in various embodiments, a plurality of magnets and coils of wire may be disposed opposite each other on either the rotor or the stator and have the same effect. Further, in various embodiments, a plurality of magnets may be permanent magnets or electromagnets and have the same effect.

In the embodiment shown, the tangential turbine 320 is disposed within a sidewall of the drill pipe 315. A rotational axis of the tangential turbine 320 may be parallel to the central axis of the drill pipe while also being offset from the central axis. In this configuration, the primary drilling fluid 323 passing through the drill pipe 315 is not obstructed by the tangential turbine 320, allowing for objects to be passed through the drill pipe 315 generally unhindered.

An outlet 332 for discharging the diverted portion of drilling fluid 333 to an exterior of the drill pipe 315 may be disposed on a sidewall of the drill pipe 315. In the embodiment shown, a check valve 334 is further disposed within the outlet to allow fluid to exit the drill pipe 315 but not enter.

Polycrystalline diamond (PCD) bearings 331 may support the tangential turbine 320 and rotor 321 allowing them to rotate. It is believed that PCD bearings may require less force to overcome friction than traditional mud-lubricated bearing systems described in the prior art. It is further believed that PDC bearings may be shaped to comprise a gap therebetween sufficient to allow an amount of fluid to pass through while blocking particulate. Allowing fluid to pass while blocking particulate may be desirable to transport heat away from a generator or balance fluid pressures.

Figure 4:
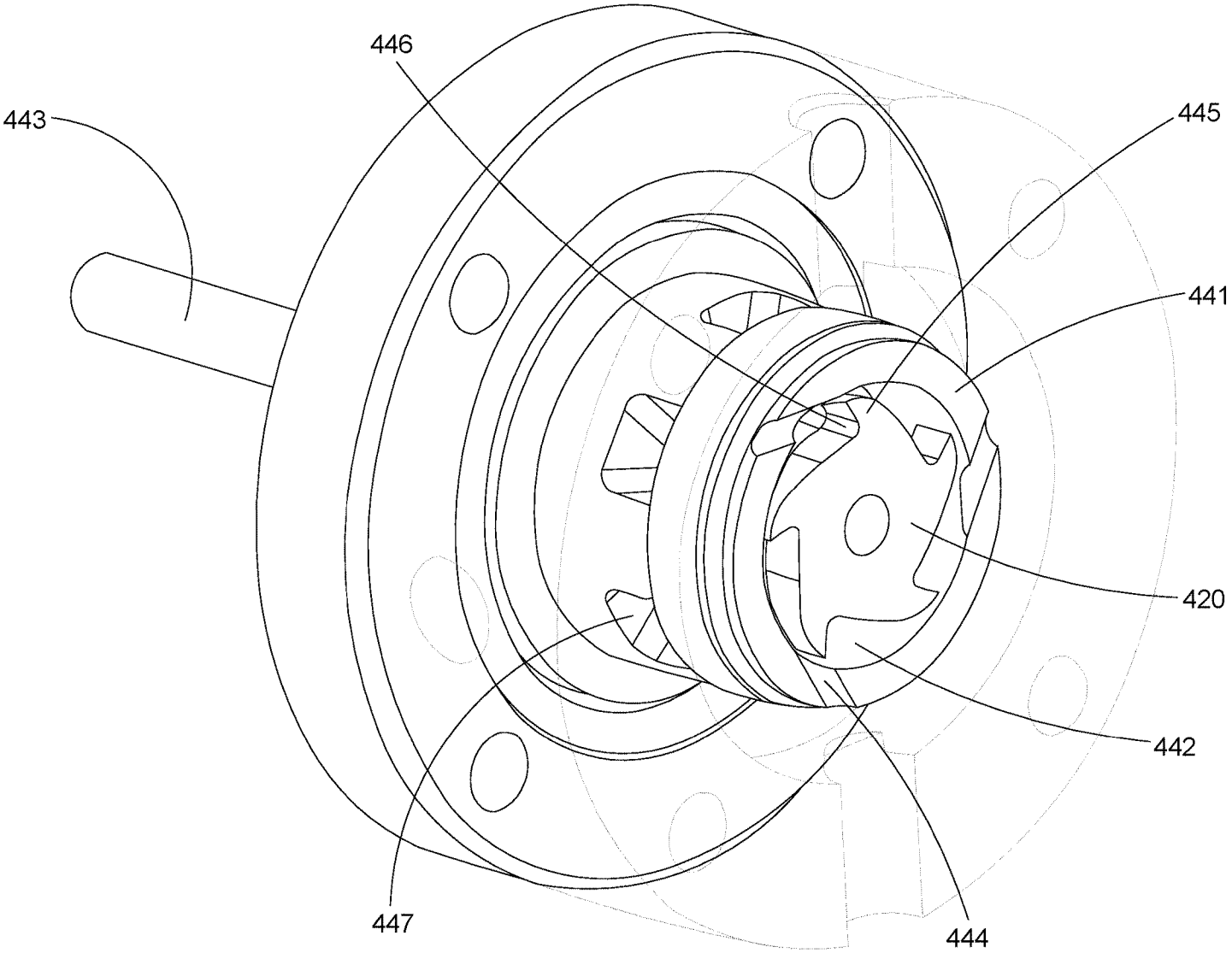
FIG. 4 is a perspective view of an embodiment of a downhole turbine device (shown partially transparent for clarity).

FIG. 4 discloses a possible embodiment of a tangential turbine device (part of which is transparent for clarity). The device comprises a housing 441 with a chamber 442 disposed therein. A tangential turbine 420, such as an impulse turbine, may be disposed within the chamber 442 and attached to an axle 443 leading to a rotor (not shown). The housing 441 may comprise at least one inlet 444, wherein drilling fluid may pass through the housing 441 into the chamber 442. In the embodiment shown, the inlet 444 is disposed on a plane perpendicular to a rotational axis of the tangential turbine 420. The inlet 444 is also shown offset from the rotational axis of the tangential turbine 420 such that fluid entering the chamber 442 through the inlet 444 may impact a plurality of blades 445 forming part of the tangential turbine 420 to rotate the tangential turbine 420. Each of the plurality of blades 445 may comprise a concave surface 446 thereon, disposed on a surface generally parallel to the rotational axis of the tangential turbine 420, to help catch fluid entering the chamber 442 and convert as much energy therefrom into rotational energy of the tangential turbine 420. In FIG. 4, three inlets are shown. However, more or less inlets may be preferable. Additionally, at least one outlet 447 may allow fluid that enters the chamber 442 to escape.

The tangential turbine 420 may comprise PCD to reduce wear from the fluid entering the chamber 442. In some embodiments, the tangential turbine 420 may be formed entirely of PCD.

Whereas the present invention has been described in particular relation to the drawings attached hereto, it should be understood that other and further modifications apart from those shown or suggested herein, may be made within the scope and spirit of the present invention.

What is claimed is:

1. A downhole turbine assembly, comprising:

a drill pipe capable of passing a fluid flow there through;

a turbine in a sidewall of the drill pipe, the turbine including a plurality of blades supported by one or more bearings, at least one blade of the turbine or at least one bearing of the one or more bearings including polycrystalline diamond, at least one of the one or more bearings being shaped to include a gap therebetween that is sufficient to allow an amount of the fluid to pass through while blocking particulate for heat transfer or pressure balance;

a course capable of diverting a portion of the fluid flow into the turbine and directing the fluid flow toward the turbine along a flow path that is perpendicular to a rotational axis of the turbine; and an outlet capable of discharging the diverted portion of the fluid flow from the turbine within the drill pipe to an exterior of the drill pipe.

2. The downhole turbine assembly of claim 1, wherein the turbine is fully within the sidewall of the drill pipe.

3. The downhole turbine assembly of claim 1, wherein the outlet is on the sidewall of the drill pipe.

4. The downhole turbine assembly of claim 1, wherein the course is offset from the rotational axis of the turbine.

5. The downhole turbine assembly of claim 1, further comprising a generator connected to the turbine.

6. The downhole turbine assembly of claim 1, wherein the turbine comprises a tangential turbine or an impulse turbine.

7. The downhole turbine assembly of claim 1, wherein the turbine is formed entirely of polycrystalline diamond.

8. The downhole turbine assembly of claim 1, wherein the course is capable of diverting up to 10 gallons/minute (0.03785 $m^3$/min).

9. The downhole turbine assembly of claim 1, wherein the diverted portion of the fluid flow experiences a pressure drop of 500-1000 pounds/square inch (3,447-6,895 kPa) over the turbine.

10. The downhole turbine assembly of claim 1, wherein each of the plurality of blades comprises one or more of a flat surface or a concave surface thereon.

11. The downhole turbine assembly of claim 10, wherein a concave surface on each of the plurality of blades is on a surface generally parallel to a rotational axis of the turbine.

12. The downhole turbine assembly of claim 1, wherein the turbine comprises a rotational axis parallel to but offset from a central axis of the drill pipe.

13. The downhole turbine assembly of claim 1, wherein the turbine does not obstruct the fluid flow passing through the drill pipe.

14. The downhole turbine assembly of claim 1, wherein the outlet comprises a check valve.

15. The downhole turbine assembly of claim 1, the outlet being capable of discharging the diverted portion from the turbine by flowing the diverted portion in a direction opposite the fluid flow in the drill pipe.

16. A downhole turbine assembly, comprising:

a drill pipe capable of passing a fluid flow there through;

a turbine within a sidewall of the drill pipe, the turbine including a plurality of blades supported by one or more bearings, at least one blade of the turbine or at least one bearing of the one or more bearings including polycrystalline diamond, at least one of the one or more bearings being shaped to include a gap therebetween that is sufficient to allow an amount of the fluid to pass through while blocking particulate for heat transfer or pressure balance;

a course capable of diverting a portion of the fluid flow to the turbine, the course including an inlet; and an outlet capable of discharging the diverted portion of the fluid flow from within the drill pipe to an exterior of the drill pipe.

17. The downhole turbine assembly of claim 16, wherein a rotational axis of the turbine is parallel to a central axis of the drill pipe.

18. The downhole turbine assembly of claim 16, further comprising a rotor connected to the turbine, the rotor including a plurality of magnets and a coil of wire, wherein movement of the plurality of magnets induces electrical current in the coil.

19. The downhole turbine assembly of claim 16, wherein the outlet is located uphole relative to at least one of the turbine or the course.

20. A downhole turbine assembly, comprising:

a drill pipe capable of passing a fluid flow there through;

a turbine in a sidewall of the drill pipe, the turbine including one or more bearings supporting a plurality of blades, the one or more bearings or the plurality of blades including polycrystalline diamond;

a course capable of diverting a portion of the fluid flow into the turbine, wherein the course is on a plane perpendicular to a rotational axis of the turbine; and an outlet capable of discharging the diverted portion of the fluid flow from within the drill pipe to an exterior of the drill pipe, wherein the outlet is capable of discharging the diverted portion of the fluid flow to a location on the exterior of the drill pipe that is uphole of at least one of the turbine or the course.

* * * * *